US005375924A

United States Patent [19]

Pohl et al.

[11] Patent Number: 5,375,924

[45] Date of Patent: Dec. 27, 1994

[54] ADJUSTABLE REFRIGERATOR DOOR TRAY ASSEMBLY

[75] Inventors: Douglas A. Pohl; Richard D. Smith, Jr., both of Galesburg; Jane A. Albert, Monmouth; Gloria J. Corbin, Cameron, all of Ill.

[73] Assignee: Maytag Corporation, Newton, Iowa

[21] Appl. No.: 119,945

[22] Filed: Aug. 13, 1993

[51] Int. Cl.[5] ..... F25D 11/00

[52] U.S. Cl. ..... 312/405.1; 108/109

[58] Field of Search ..... 312/405.1, 404, 408, 312/109, 110, 187, 190, 191

[56] References Cited

U.S. PATENT DOCUMENTS

| | | | |
|---|---|---|---|
| 1,596,296 | 4/1926 | Oberdorfer . | |
| 2,047,996 | 7/1936 | Crosley, Jr. et al. . | |
| 2,061,453 | 11/1936 | Crosley, Jr. et al. . | |
| 2,074,438 | 3/1937 | Swedman . | |
| 2,116,619 | 5/1938 | Crosley, Jr. et al. . | |
| 2,201,114 | 5/1940 | Peltier et al. . | |
| 2,576,691 | 11/1951 | Money . | |
| 2,749,718 | 6/1956 | Saunders . | |
| 2,784,044 | 3/1957 | Kurowski . | |
| 2,840,433 | 6/1958 | Richard et al. . | |
| 2,840,434 | 6/1958 | Moore et al. . | |
| 2,852,328 | 9/1958 | Jewell et al. . | |
| 2,872,144 | 2/1959 | Hobson . | |
| 2,877,077 | 3/1959 | Robinson et al. . | |
| 2,898,173 | 8/1959 | Squire . | |
| 2,917,355 | 12/1959 | Squire . | |
| 2,970,873 | 2/1961 | Johnson . | |
| 2,976,098 | 3/1961 | Combs . | |
| 3,029,953 | 4/1962 | Morrissey, Jr. . | |
| 3,056,640 | 10/1962 | Squire . | |
| 3,220,558 | 11/1965 | Olsson | 312/405.1 |
| 3,347,187 | 10/1967 | Khoury . | |
| 3,375,936 | 4/1968 | Kessler . | |
| 3,469,711 | 9/1969 | Swaneck et al. . | |
| 3,647,075 | 3/1972 | Aue . | |
| 3,682,521 | 8/1972 | Kesling . | |
| 3,709,576 | 1/1973 | Lemoine . | |
| 3,807,822 | 4/1974 | Amore . | |
| 4,051,789 | 10/1977 | Howitt . | |
| 4,186,978 | 2/1980 | Thomson . | |
| 4,423,817 | 1/1984 | Monjo-Rufi . | |
| 4,779,939 | 10/1988 | Stich . | |
| 4,801,182 | 1/1989 | Metcalfe et al. . | |
| 4,859,010 | 8/1989 | Jeziorowski . | |
| 4,867,512 | 9/1989 | Wilkins et al. . | |
| 4,908,544 | 3/1990 | Lau . | |
| 4,921,315 | 5/1990 | Metcalfe et al. . | |
| 5,004,305 | 4/1991 | Montuoro et al. . | |
| 5,193,892 | 3/1993 | Swindell | 312/405.1 |

*Primary Examiner*—Kenneth J. Dorner
*Assistant Examiner*—Gerald A. Anderson
*Attorney, Agent, or Firm*—Bacon & Thomas

[57] ABSTRACT

A refrigerator door tray assembly is disclosed in which the inner door panel has opposite sidewalls defining a space, a tray having support surfaces on opposite sides of the tray and a mounting device to removably and adjustably attach the tray to the door such that the tray is located between the opposite sidewalls of the door and such that its position may be easily adjusted, or the tray removed from the door. The mounting of the tray on the door is accomplished by a plurality of ribs extending inwardly from the opposite sidewalls of the door, each rib having first and second rib surfaces which extend at acute angles to the support surfaces on the tray, and a third rib surface which extends substantially parallel to the support surfaces. The tray has, in addition to the first and second support surfaces, first, second and third tray surfaces on each opposite sides of the tray located such that the first and second tray surfaces may slidably contact the first and second rib surfaces of a first rib while the third tray surface slidably contacts a first rib surface of an adjacent rib.

12 Claims, 4 Drawing Sheets

ADJUSTABLE REFRIGERATOR DOOR TRAY ASSEMBLY

BACKGROUND OF THE INVENTION

The present invention relates to a storage tray or bin for a refrigerator door, more particularly such a tray or bin which may be easily removable from the door and in which the position of the tray or bin relative to the door is readily adjustable.

It is known to provide the inner portion of a refrigerator door with movable trays or bins for the storage of food products. Typically, the bins are readily removable from the door to facilitate loading and unloading the food product and their positions are adjustable vertically on the door to enable various sizes of food products to be stored in the tray or bin. Such organizational versatility also enhances the ability to clean the interior space of the refrigerator, as well as to clean the trays or bins.

Over the years, various attaching means have been tried to removably and adjustably attach the trays or bins to the interior of the refrigerator door. Early attempts involved brackets having one portion attached to the inner door panel and an opposite and engaging portion attached to the tray or bin. However, modem refrigerator construction utilizes a molded plastic liner to form the inner door surface, which liner is attached to an outer door panel, usually metal, with insulation inserted between the outer panel and the inner liner. In order to both maximize the interior useable space of the refrigerator, and to minimize production costs, it is desirable to form the inner liner from as thin a plastic material as possible. The use of such a thin material generally prohibits separate attaching brackets to removably and adjustably attach storage trays or bins to the door panel.

It is also known to form integral ribs or shoulders on the door liner to support the storage trays or bins. While generally successful, the known molded ribs or shoulders often require the use of separate, friction generating attaching devices inserted between the storage tray or bin and the rib or shoulder to ensure that the tray or bin remains attached to the door as the door is opened or closed. The use of such friction generating devices increase both the complexity of the door structure, as well as the manufacturing costs.

One attempted solution to this problem was to orient the ribs or shoulders to a more vertical position, thereby requiring the storage tray or bin to be lifted vertically as it is being removed from the door. This attempt has not really solved the problem, since it requires the user to exert a lifting force on the storage tray or bin, which may be quite substantial depending upon the food products stored in the tray or bin.

SUMMARY OF THE INVENTION

A refrigerator door tray assembly is disclosed in which the inner door liner has opposite sidewalls defining a space, a tray having support surfaces on opposite sides of the tray and a mounting device to removably and adjustably attach the tray to the door such that the tray is located between the opposite sidewalls of the door and such that its position may be easily adjusted, or the tray removed from the door.

The mounting of the tray on the door is accomplished by a plurality of ribs extending inwardly from the opposite sidewalls of the door, each rib having first and second rib surfaces which extend at acute angles to the support surfaces on the tray, and a third rib surface which extends substantially parallel to the support surfaces. The tray has, in addition to the first and second support surfaces, first, second and third tray surfaces on each opposite side of the tray located such that the first and second tray surfaces may slidably contact the first and second rib surfaces of a first rib while the third tray surface slidably contacts a first rib surface of an adjacent rib. Support of the tray on the door is accomplished by contact between the first and third rib surfaces contacting the first tray and first support surfaces, as well as contact between the first rib surface of an adjacent rib and the third tray surfaces.

The plurality of ribs may be integrally molded with the inner door liner and the various support surfaces and tray surfaces may be integrally molded with the tray. The acute angles of the first and second rib surfaces enable the tray to be easily slid onto the ribs. The contact between the first and third rib surfaces against the first tray and second support first on each opposite side of the tray, as well as contact between the first rib surface of an adjacent rib and the third tray surface provide support for the tray.

The door tray assembly according to the present invention provides a door storage tray attachment using the inner door and the removable door tray in an interlocking fashion which uses gravity to prevent easy disengagement of the tray once it has been assembled to the door liner. The invention also provides an improved degree of adjustability within the inner door by integrally molding the mating components on the door liner and the tray. The system is such that it allows blind installation of the storage trays.

DETAILED DESCRIPTION OF THE PREFERRED EMBODIMENT

Figure 1:
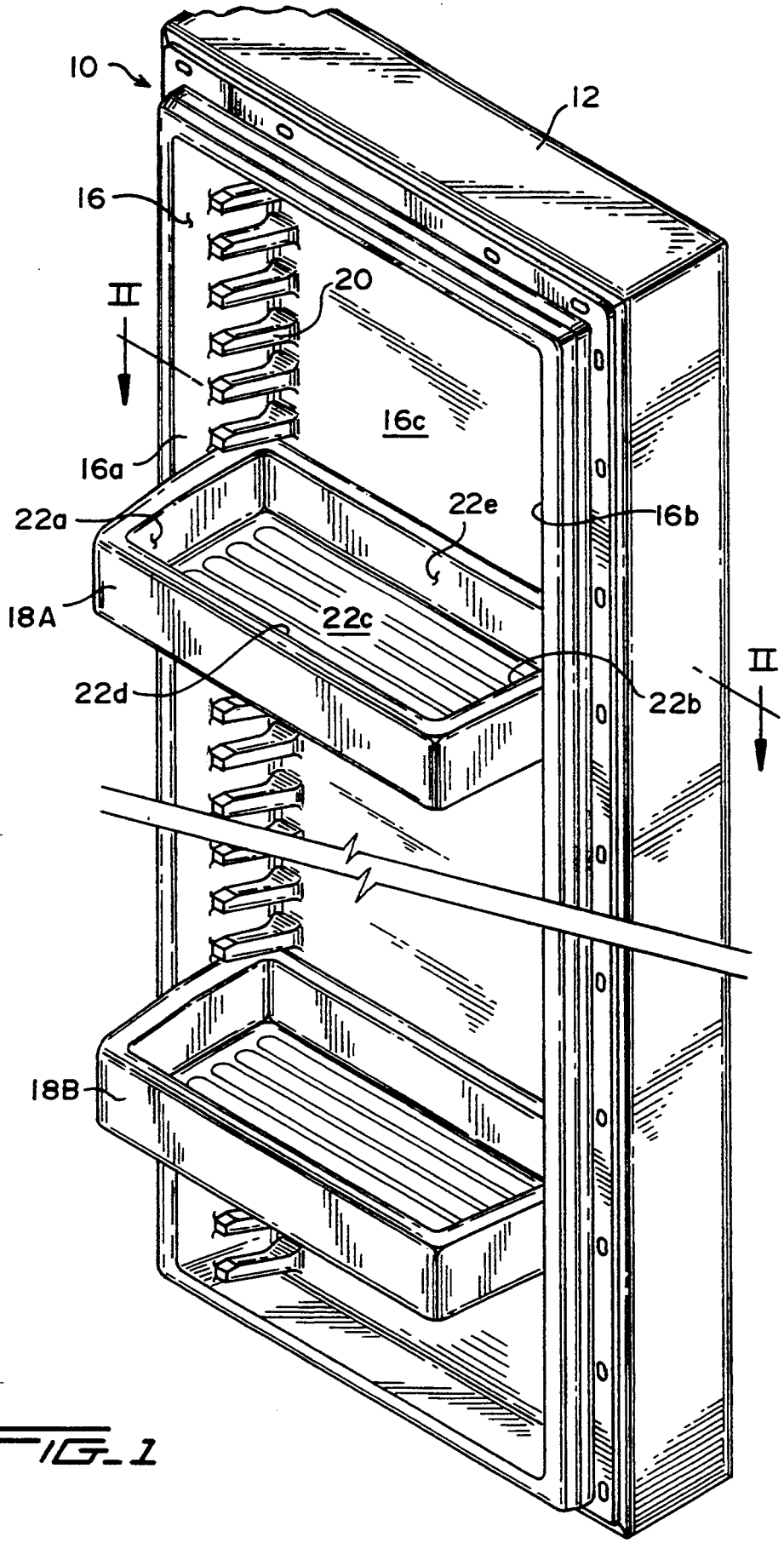
FIG. 1 is a perspective view of a refrigerator door including the door tray assembly according to the present invention.
Figure 2:
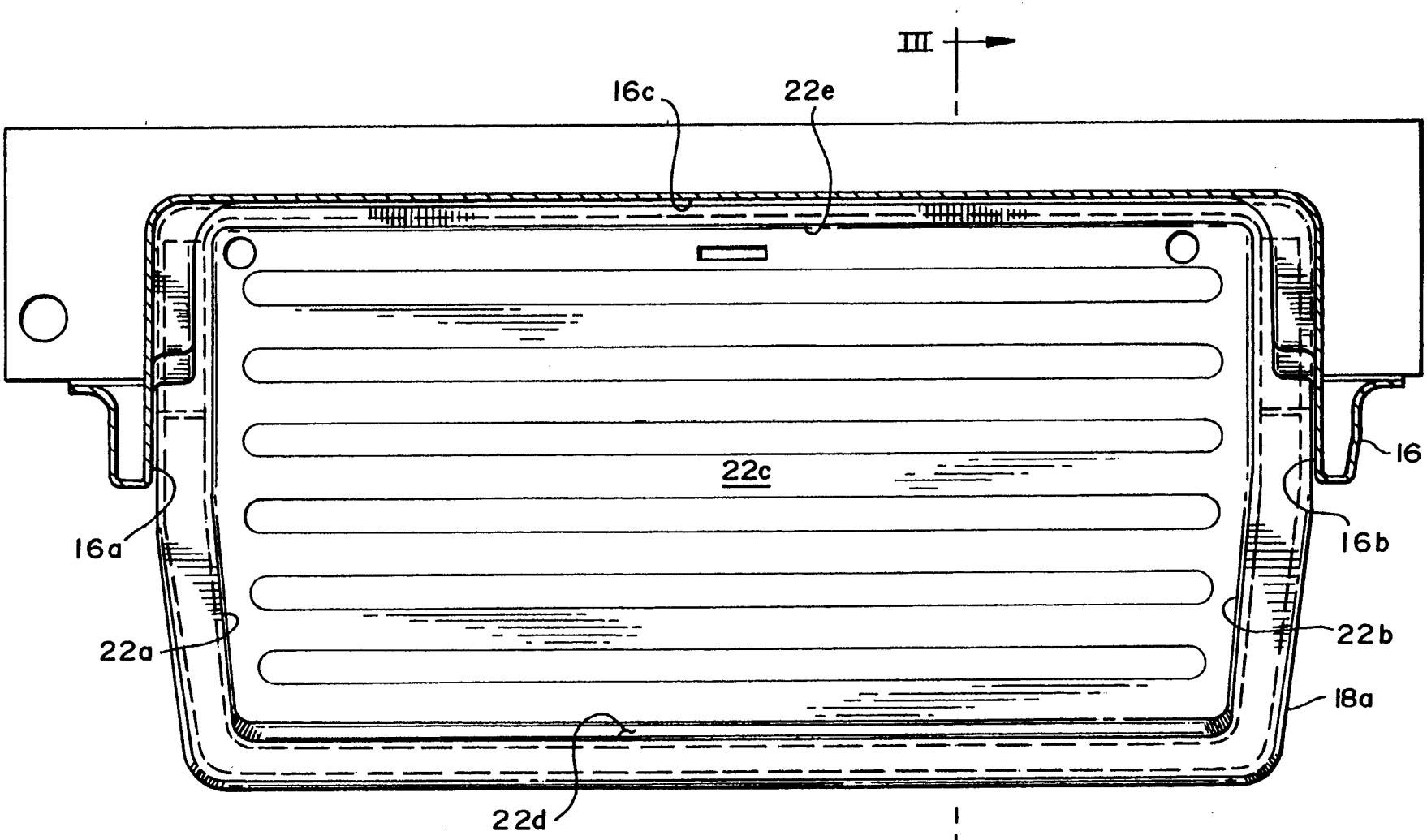
FIG. 2 is a top view of the door tray assembly taken along line II—II in FIG. 1.

FIG. 1 illustrates a refrigerator door 10 comprising an outer shell 12, typically fabricated from metal, door inner liner 16 and storage trays or bins 18. Door inner liner 16 has opposite sidewalls **16*a* and 16*b* which are interconnected by a rear wall 16*c* and may be integrally molded from a plastic material in known fashion. Opposite sidewalls 16*a* and 16*b* define a space therebetween and have a plurality of ribs 20 extending inwardly from each sidewall into the space between them. The ribs 20 serve to removably attach the storage trays or bins 18 to the door 10 and allow the vertical positions of the storage trays 18** to be easily adjusted.

The storage tray 18 may comprise opposite sidewalls **22*a* and 22*b* and a bottom 22*c*. A front wall 22*d* and a rear wall 22*e* may also be provided extending upwardly from the bottom 22*c***.

Figure 3:
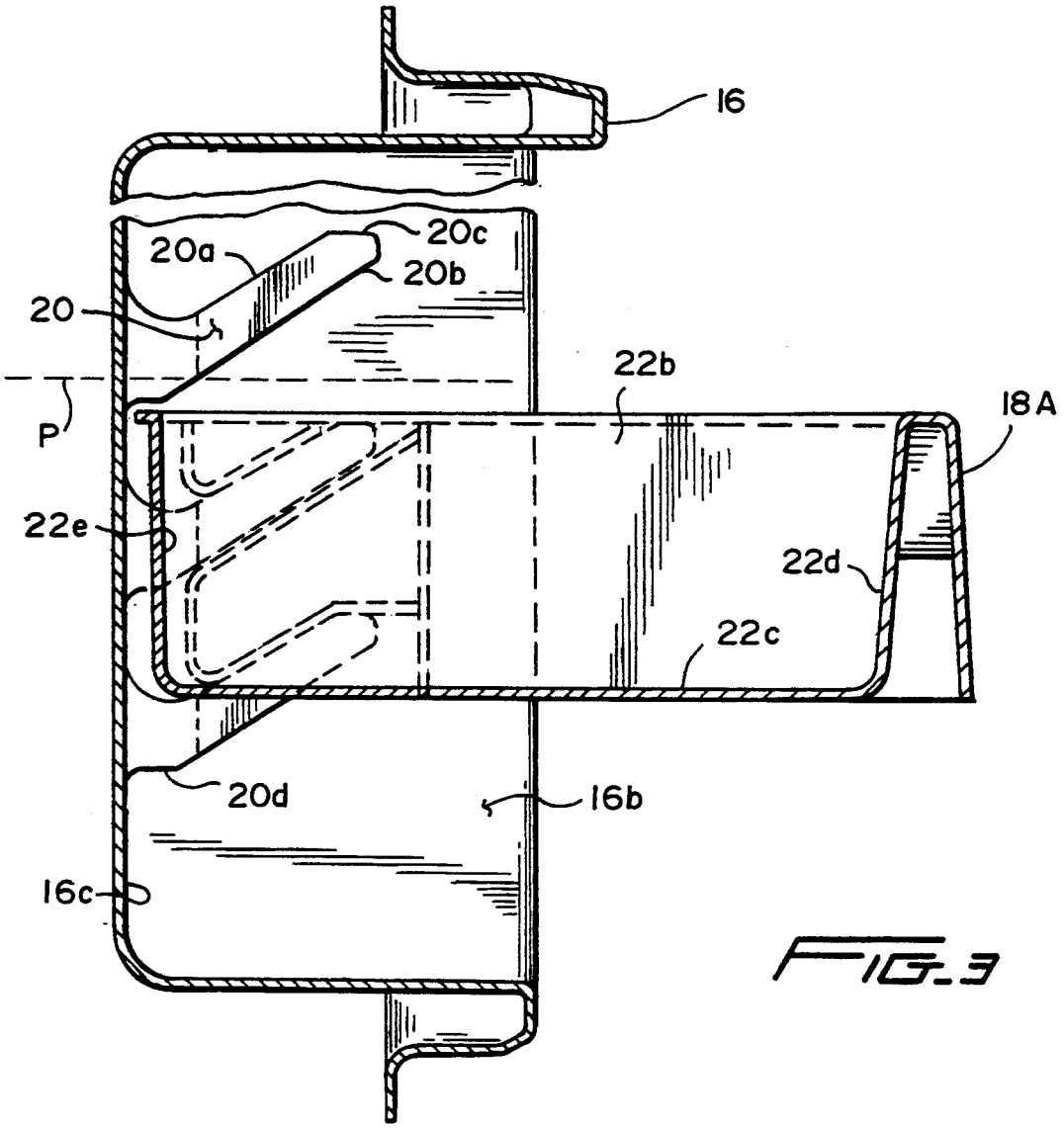
FIG. 3 is a cross-sectional view taken along line III—III in FIG. 2.
Figure 4:
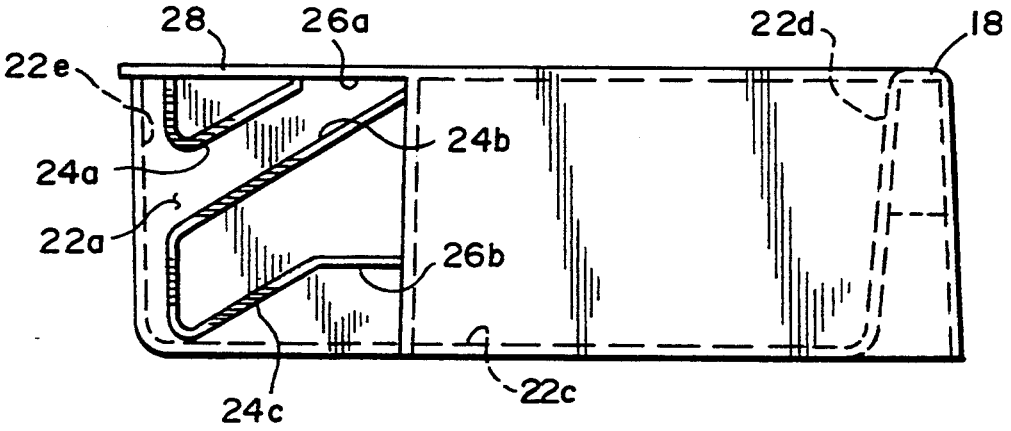
FIG. 4 is a side view of the tray utilized in the door tray assembly according to the present invention.
Figure 5:
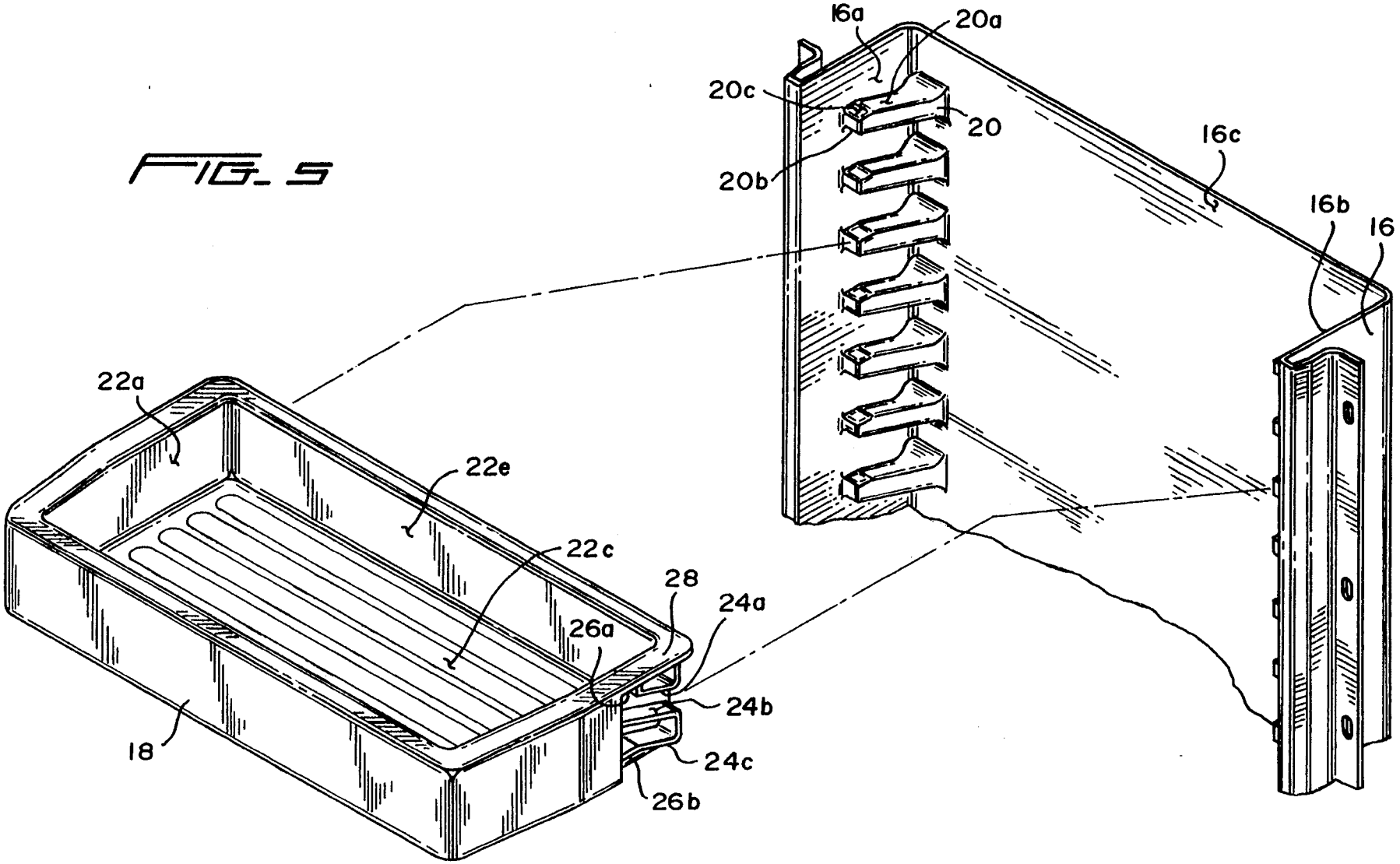
FIG. 5 is a partial, exploded perspective view of the door liner and the tray according to the present invention.

As best seen in FIGS. 3–5, each rib 20 has first rib surface 20*a*, second rib surface 20*b* and third rib surface 20*c*. First rib surface 20*a* and second rib surface 20*b* form acute angles with respect to a generally horizontally extending plane P. The angle of first rib surface 20*a* may be less than the angle of surface 20*b*. The angle subtended by the first rib surface 20*a* may be on the order of 30°, while the angle subtended by second rib surface 20*b* may be on the order of 32.5°. Third rib surface 20*c* extends substantially parallel to the horizontal plane P.

FIG. 4 is a side view of a storage tray or bin 18 and, as can be seen, each opposite side of the tray 18 has a first tray surface 24*a*, a second tray surface 24*b* and a third tray surface 24*c*. Each tray 18 also defines a first support surface 26*a* and a second support surface 26*b*. The tray surfaces and the support surfaces extend generally outwardly from a portion of the side surfaces 22*a* and 22*b*. Tray 18 has an upper peripheral edge 28 which may extend outwardly from opposite sidewalls 22*a* and 22*b* and a portion of the upper peripheral edge 28 may define the first support surfaces 26*a*.

In order to attach the storage tray 18 to the refrigerator door 10, it is merely necessary to slide the tray inwardly and downwardly into the door liner such that the first tray surface 24*a*, and the second tray surface 24*b* slidably contact the first rib surface 20*a* and the second rib surface 20*b* of a first rib 20. Upper peripheral edge 28 must also slide past rib surface 20*d* to ensure final tray engagement, although normally no contact exists subsequent to final tray engagement. As can be seen best in FIG. 3, the third tray surface 24*c* will slidably contact the first rib surface 20*a* of an adjacent rib 20. The tray 18 is held in position by the forces of gravity via contact between the first and third rib surfaces 20*a* and 20*c* of the first rib 20 and the first tray and first support surfaces 24*a* and 26*a*, as well as by contact between the first rib surfaces 20*a* of the adjacent rib 20 and the third tray surfaces 24*c*. Thus, it can be seen that the tray or bin 18 is supported vertically by the third rib surface of the first rib 20, as well as by engagement of the first tray surface 24*a* and the third tray surface 24*c* with first rib surface 20*a* of two adjacent ribs 20. Removal of the tray 18 from the door 10 is accomplished by merely sliding the tray 18 upwardly and outwardly from the inner liner 16.

Each of the ribs 20 may also define a fourth rib surface 20*d* between the rear wall 16*c* and the second rib surface 20*b*. Fourth rib surface 20*d* is located such that it is normally out of contact with the upper peripheral edge 28 of tray 18. However, contact between the upper peripheral edge 28 and the fourth rib surface 20*d* may occur if a significant weight of food product is placed in the tray 18. Fourth rib wall 20*d* is generally horizontally oriented such that contact between it and the upper peripheral edge 28 will tend to prevent the disengagement of the tray 18 from the door liner 16.

The foregoing description is provided for illustrative purposes only and should not be construed as in any way limiting this invention, the scope of which is defined solely by the appended claims.

We claim:

1. A door tray assembly comprising:

a) a door having opposite side walls defining a space therebetween;

b) a tray having first and second support surfaces extending in first and second generally parallel planes on each opposite side of the tray; and, c) mounting means to removably and adjustably attach the tray to the door such that the tray is located between the opposite sidewalls, wherein the mounting means comprises:

i) a plurality of ribs extending from each opposite side wall into the space, each rib having first and second rib surfaces extending at acute angles with respect to the first and second planes of the first and second support surfaces and a third rib surface extending substantially parallel to the first and second planes of the first and second support surfaces; and, ii) first, second and third tray surfaces on each opposite side of the tray located such that the first and second tray surfaces slidably contact the first and second rib surfaces of a first rib, and the third tray surface slidably contacts a first rib surface of an adjacent rib, the third rib surface of the first rib contacting the first support surface of the tray and the third rib surface of the adjacent rib contacting the second support surface of the tray to locate and support the tray on the door in a predetermined position.

2. The door tray assembly of claim 1 wherein the first rib surface extends at a first acute angle with respect to a substantially horizontal plane and the second rib surface extends at a second acute angle with respect to a substantially horizontal plane.

3. The door tray assembly of claim 2 wherein the first acute angle is less than the second acute angle.

4. The door tray assembly of claim 2 wherein the first acute angle is approximately 30°.

5. The door tray assembly of claim 2 wherein the second acute angle is approximately 32.5°.

6. The door tray assembly of claim 1 wherein the first and second support surfaces extend substantially horizontally.

7. The door tray assembly of claim 1 wherein the door has a rear wall extending between the opposite sides and further comprising a fourth rib surface between the second rib surface and the rear wall located so as to be normally spaced from the tray.

8. The door tray assembly of claim 1 wherein the first and third tray surfaces extend substantially parallel to each other.

9. The door tray assembly of claim 1 wherein the tray further comprises side walls, and wherein the first and second support surfaces extend outwardly from the tray side walls.

10. The door tray assembly of claim 9 wherein the first, second and third tray surfaces extend outwardly from the tray side walls.

11. The door tray assembly of claim 1 wherein the tray further comprises an upper peripheral edge, such that a portion of the upper peripheral edge defines the first support surfaces.

12. A door tray assembly comprising:

a) a door having opposite side walls defining a space therebetween and a rear wall extending between the opposite side walls;

b) a tray having first and second support surfaces extending in first and second substantially horizontal substantially parallel planes on each opposite side of the tray; and, c) mounting means to removably and adjustably attach the tray to the door such that the tray is located between the opposite sidewalls, wherein the mounting means comprises:

i) a plurality of ribs extending from each opposite side wall into the space, each rib having first and second rib surfaces extending at acute angles with respect to the first and second substantially horizontal substantially parallel planes, a third rib surface extending substantially parallel to the first and second substantially horizontal substantially parallel planes on the tray and a fourth rib surface extending substantially horizontally between the second rib surface and the rear wall, and located so as to be normally spaced from the tray; and, ii) first, second and third tray surfaces formed on each opposite side of the tray located such that the first and second tray surfaces slidably contact the first and second rib surfaces of a first rib, and the third tray surface slidably contacts a first rib surface of an adjacent rib, the third rib surface of the first rib contacting the first support surface of the tray and the third rib surface of the adjacent rib contacting the second support surface to locate and support the tray on the door in a predetermined position.

* * * * *